United States Patent [19]

Goedicke

[11] 4,148,860

[45] Apr. 10, 1979

[54] CATALYTIC CONVERTER FOR EXHAUST GASES

[75] Inventor: Eitel Goedicke, Ahe, Fed. Rep. of Germany

[73] Assignee: Hoechst Aktiengesellschaft, Frankfurt am Main, Fed. Rep. of Germany

[21] Appl. No.: 857,129

[22] Filed: Dec. 5, 1977

[30] Foreign Application Priority Data

Dec. 9, 1976 [DE] Fed. Rep. of Germany ..... 2655751

[51] Int. Cl.[2] ..... B01J 8/02; F01N 3/15

[52] U.S. Cl. ..... 422/176; 422/181; 60/299

[58] Field of Search ..... 23/288 F; 60/299

[56] References Cited

U.S. PATENT DOCUMENTS 3,594,131 7/1971 De Palma et al. ..... 23/288 F

*Primary Examiner*—Sidney Marantz
*Assistant Examiner*—Bradley Garris
*Attorney, Agent, or Firm*—Connolly and Hutz

[57] ABSTRACT

Device for holding a granular catalyst suitable for use in the decontamination of exhaust gas from an internal combustion engine. The device comprises a housing which is closed by means of end plates and provided with a gas inlet and gas outlet and in which there is disposed a sleeve having perforated walls which are substantially circular in cross-section, this sleeve being disposed therein substantially concentrically with respect to the gas inlet. The device is provided with one or more flow-defining means which are accommodated in the housing, the gas flow-defining means causing gas admitted to the housing to be at least partially directed in a substantially axial direction so as to form a stream flowing under increased static pressure towards one of the end regions of the sleeve.

6 Claims, 4 Drawing Figures

CATALYTIC CONVERTER FOR EXHAUST GASES

This invention relates to a device for holding a granular catalyst suitable for use in the decontamination of exhaust gas from an internal combustion engine, the device comprising a housing which is closed by means of end plates and provided with a gas inlet and gas outlet, and in which there is disposed a sleeve having a substantially circular cross-section and having perforated walls, this sleeve being disposed therein substantially concentrically with respect to the gas inlet.

Various catalysts which enable noxious constituents of exhaust gases to be transformed into harmless compounds have already been described. These catalysts may be used in the form of a monolithic structure or in the form of granular material, e.g. pellets or moulded material.

As a result of the conditions which prevail in the vicinity of the engines concerned, and which entail temperature changes and mechanical vibration, the catalysts are subject to heavy stress. In the case of a granular ceramic catalyst, which is normally placed in a metal container, it is naturally necessary to consider the difference between the thermal expansion coefficients of the container on the one hand, and of the catalyst on the other. This difference is of particular importance if the exhaust gas decontamination device is mounted near the engine concerned and has to tolerate working temperatures of 1000° C. or even more.

Inasmuch as the catalyst granules undergo less thermal expansion than the container, they can move freely within the container to an increasing extent with increasing temperatures. In consequence, the catalyst granules can undergo abrasion which in practice means loss of catalyst efficiency, and, in the end, inoperativeness of the exhaust gas decontamination device.

Devices have been described in which a granular catalyst, which is placed in a container, can be held in position by mechanical or pneumatic means so as to avoid the undesirable phenomenon of abrasion. More specifically, devices have been described in which a bed of catalyst is mechanically held in position by means of a spring permitting axial pressure to be exerted against the catalyst bed, the spring being disposed either within the housing (cf. U.S. Pat. No. 3197287) or outside it (cf. German Patent Specification ("Offenlegungsschrift") No. 2242888). The use of pneumatic means for holding a catalyst in position has heretofore been described only in connection with what has been called a flat bed reactor; here the exhaust gas is admitted to a horizontally arranged housing so as to exert pressure against the top of a catalyst bed accommodated therein (cf. U.K. Specification No. 1357241).

U.S. Pat. No. 3449086 describes a silencer having a catalytic function, which comprises a housing closed by means of end plates, the end plates having a gas inlet and gas outlet passed therethrough. Disposed in the interior of the housing is a circular container having perforated walls, which holds a granular catalyst. More specifically, the inside wall of the container is arranged so as to be in alignment with the gas outlet. The container is connected at one end to the end plate at the gas inlet end of the housing, the opposite end of the container being closed by means of a cap which is bolted securely to the end plate at the gas outlet end of the housing. An upper portion of the container, i.e. a portion subtending 20° to 120° at the axis thereof, is rendered impermeable to gas by means of an appropriately shaped covering plate.

A disadvantage encountered with a catalytic device as described in the somewhat earlier U.S. Pat. No. 3197287, mentioned previously, is that the spring disposed within the housing is exposed to temperatures of up to 1000° C., so that it is soon liable to lose its resilience. In the device described in the previously mentioned German Patent Specification ("Offenlegungsschrift") No. 2242888, on the other hand, it is difficult to arrange for the thrust rod transmitting the pressure of the external spring to be gastightly passed through the cover of the housing. The device disclosed in the previously mentioned U.K. patent specification No. 1357241 has the disadvantage that, since the gas is admitted from above, the device is necessarily mounted in a horizontal position if it is to remain operational. The device described in the previously mentioned U.S. Pat. No. 3449086 merely permits the fluidization of catalyst granules to be reduced in an upper layer of the catalyst; it does not permit the catalyst to be pneumatically held in position.

It is an object of the present invention to provide a device for holding a granular catalyst suitable for use in the decontamination of exhaust gas from an internal combustion engine, in which use is made of the exhaust gas for compressing a bed of the catalyst granules and for keeping it in a fixed position so as to avoid catalyst abrasion and eliminate paths for the exhaust gas which by-pass the catalyst bed.

According to the present invention, we provide a device for holding a granular catalyst suitable for use in the decontamination of exhaust gas from an internal combustion engine, the device comprising a housing which is closed by means of end plates and provided with a gas inlet and gas outlet and in which there is disposed a sleeve having perforated walls which are substantially circular in cross-section, this sleeve being disposed therein substantially concentrically with respect to the gas inlet; in which device one or more gas flow-defining means are accommodated in the housing, the gas-flow-defining means causing gas admitted to the housing to be at least partially directed in a substantially axial direction so as to form a stream flowing under increased static pressure towards one of the end regions of the sleeve.

Preferred features of the present invention provide:

(a) for the device to have gas flow-defining means comprising a gas deflecting cone which is fixed to a first metal collar secured substantially perpendicularly to one of the end plates, a second metal collar secured substantially perpendicularly to that end plate, and an annular plate connected substantially perpendicularly to the second metal collar, the said first metal collar, within the region of the gas deflecting cone, being perforated;

(b) for a third metal collar to be connected substantially perpendicularly to the said one of the end plates between the first and second metal collars specified in "(a)";

(c) for the third collar specified in "(b)" to be provided, around its periphery, with apertures in a region thereof close to the said one of the end plates;

(d) for the device to have gas flow-defining means comprising a gas-distributing collar which is fixed to a first metal collar secured substantially perpendicularly to one of the end plates, a second metal collar secured substantially perpendicularly to that end plate, and an annular plate connected substantially perpendicularly to the second metal collar, the said first metal collar, upstream of the gas-distributing collar, being perforated;

(e) for the gas-distributing collar specified in "(d)" to be continued beyond the periphery of the said first metal collar so as to terminate in a gas guide plate;

(f) for the gas flow-defining means to comprise one of the said end plates, this end plate being provided with apertures, a metal collar which is secured substantially perpendicularly to the apertured end plate, and an annular plate secured substantially perpendicularly to the said metal collar;

(g) for the gas flow-defining means specified in "(f)" to additionally comprise a cover which is secured to the housing or a jacket forming part thereof, and which closes off the apertured end plate from the outside;

(h) for the gas flow-defining means specified in "(f)" to additionally comprise an annular cover secured to the housing or a jacket forming part thereof, and also to the gas inlet, this annular cover closing off the apertured end plate from the outside, a gas distributing collar being disposed inside the gas inlet, and the gas inlet being perforated in the region thereof downstream of the annular cover and upstream of the gas distributing collar; and (i) for at least one of the said end plates to be provided, within the region bounded by the said sleeve, with a closable catalyst inlet.

In a device in accordance with this invention, a portion of a stream of exhaust gas flowing radially through the above-mentioned sleeve can be redirected, at the end opposite the gas inlet, so as to form a stream of axially flowing gas; or instead a portion of the gas admitted axially to the housing is kept in axial flow with merely a slight parallel displacement. In both of these two cases, the gas flowing in an axial direction enables an increased gas pressure (increased in comparison with the pressure exerted by radially flowing gas) to be substantially uniformly exerted against an annular end region of the catalyst bed, and thus enables the catalyst bed to be compressed under an axial force, whereby the volume of the catalyst can be kept to a minimum.

One of the important advantages of the device of the present invention is that kinetic energy possessed by a stream of exhaust gas can be utilised to provide additional static pressure, which means that there is a pressure build-up which is directed to an annular end region of the catalyst bed. This enables shifting of the catalyst granules to be effectively inhibited in the event of cavities being formed by catalyst abrasion.

In a device in accordance with the present invention, it is possible to provide two distinct gas flow-defining means permitting portions of a stream of exhaust gas admitted to the housing to be directed against the two end regions of the catalyst bed.

In the device of the present invention, there is preferably an inner metal collar whose length is 10 to 35% of the length of the sleeve, and a metal collar which is of approximately the same length as the inner collar but is disposed outwardly of the inner collar, and which has an annular plate secured substantially perpendicularly thereto. This annular plate, which is disposed in a substantially radial orientation, preferably has a width which is 30 to 80% of the distance between the two perforated walls of the sleeve. The inner and outer metal collars and annular plate mentioned above serve to define a catalyst reservoir, in the interior of which there may be arranged a still further (i.e. a third) metal collar, with a length which is preferably 70 to 80% of the length of the outer metal collar, the said further metal collar being apertured in a region thereof close to the end plate.

The above-mentioned inner and outer metal collars which form boundaries of the above-mentioned catalyst reservoir can also serve as a seat which slidingly receives the perforated walls of the sleeve.

Also, in the present device, the gas distributing collar of the foregoing preferred features "(d)", "(e)" and "(h)" can be set at an acute angle, or can be half-cup shaped, the effect in either case being to give a reverse gas flow. The said collar can be designed so as to define an annular slit with a width preferably equal to 5 to 20% of the internal diameter of the gas inlet.

Four preferred forms of the device of the present invention are shown, in longitudinal section in each case, in the accompanying diagrammatic drawings, in which.

Figure 1:
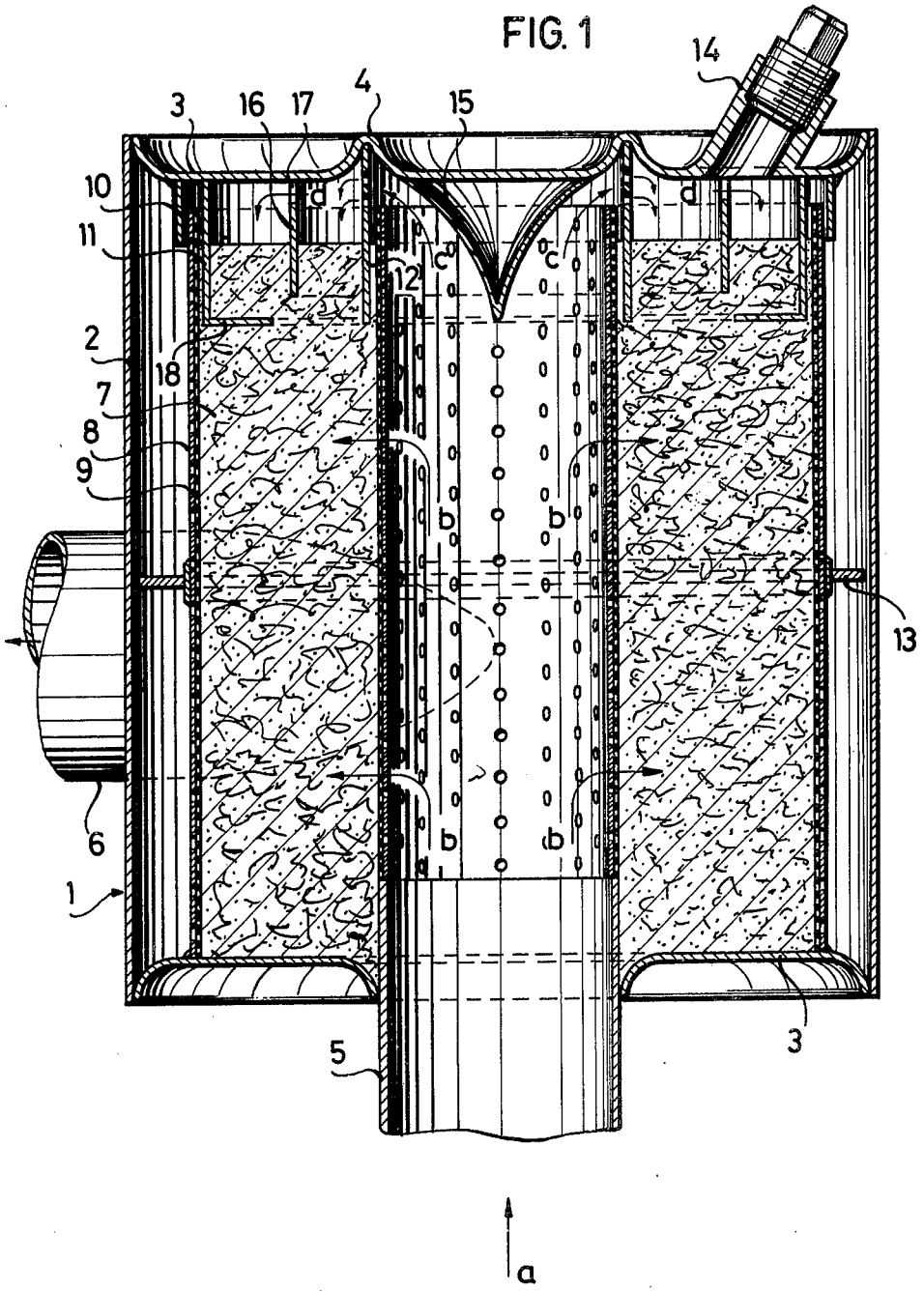
FIG. 1 shows a device provided with a gas deflecting cone and having its gas inlet disposed at its lower end.

In the devices of FIGS. 1 to 4, a jacket 2 of a housing 1 is closed by means of end plates 3, which are provided with protuberances directed inwardly, of which one boundary is shown at 4. One of the end plates 3 is provided with a gas inlet 5, and the jacket 2 has a gas outlet 6 passed through it. Arranged concentrically to the gas inlet 5 in the interior of the housing 1 is a sleeve 7 of circular cross-section, which holds a granular catalyst. The sleeve 7 has a perforated wall 8 having a wire gauze secured to its inside.

Figure 2:
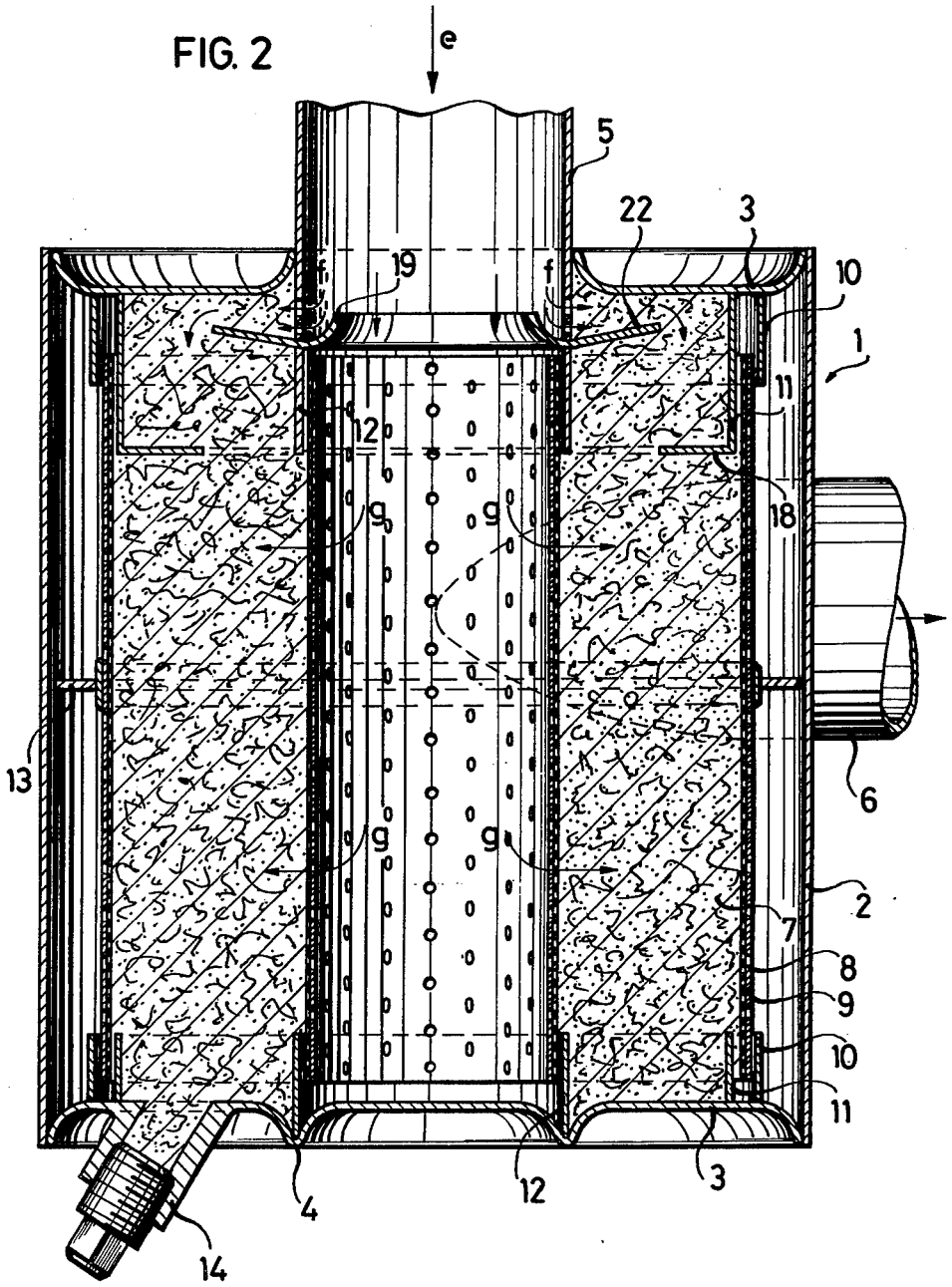
FIG. 2 shows a device having its gas inlet disposed at its upper end together with a gas distributing collar and a gas guide plate.

On the inside of at least one end plate 3 are fixed metal collars as shown at 10, 11 and 12, which slidingly receive the end portions of the sleeve 7 so as to permit compensation of relative axial motion, although, as in the device of FIG. 2, the metal collar 12 can if desired be eliminated if the gas inlet 5 is provided with an extension opening into the housing 1. One or more spacers 13 are disposed between the inside wall of the jacket 2 and the outside wall of the sleeve 7, and, where there are two or more spacers 13, they are axially separated or spaced from each other. The spacer(s) 13 is (or are) secured to the outside wall of the sleeve 7, but are free to slide on the inside wall of the jacket 2. The spacer(s) 13 may take the form of an apertured circular plate or annular plate, or may be constituted by a plurality of bolts distributed around its periphery (so as to be laterally spaced from each other). The function of the spacer(s) 13 is to accommodate radial or axial relative movements of the sleeve 7.

Within the region bounded by the sleeve 7, at least one of the end plates 3 is provided with a closable inlet 14 permitting a granular catalyst to be introduced into the sleeve 7.

In the device of FIG. 1, a gas deflecting cone 15 is arranged on the inside of one end plate 3, opposite the gas inlet 5. The upper portion of the collar 12 near the cone 15 is perforated, and a metal collar 16, provided with apertures 17 around its periphery in a region thereof close to the said one end plate 3, is secured to the inside of that end plate 3, approximately in the middle of the annular region between the collars 11 and 12. Secured perpendicularly to the collar 11 is an annular plate 18 extending inwardly, i.e. towards the interior of the housing 1. The cone 15 and collars 11 and 12 are so dimensioned as to terminate at substantially equal separations from the said one end plate 3.

In the device of FIG. 2, an extension of the gas inlet 5, which opens into the interior of the housing 1 and which performs the function of, or replaces, the collar 12, has a gas distributing collar 19 fixed to it; beyond the periphery of the extension of the gas inlet 5, the gas distributing collar 19 terminates in a gas guide plate 22. Between the upper end plate 3 and the gas guide plate 22, the extension of the gas inlet 5 is perforated. Fixed perpendicularly to the collar 11 is an annular plate 18 extending inwardly, i.e. towards the interior of the housing 1. The collar 11 and the extension of the gas inlet 5 are substantially of equal length.

Figure 3:
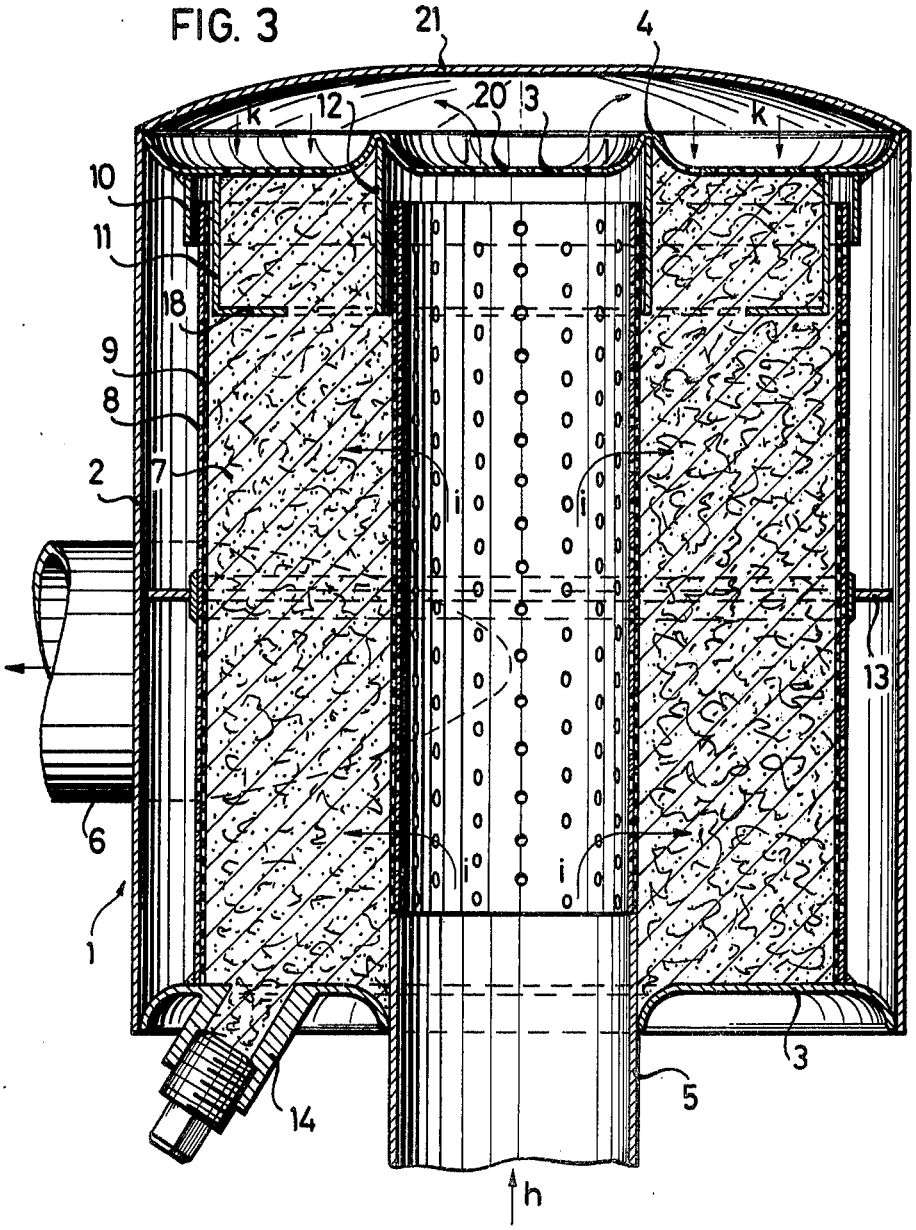
FIG. 3 shows a device provided with a perforated upper end plate, and having its gas inlet disposed at its lower end.

In the device of FIG. 3, the upper end plate 3, which is opposite the gas inlet 5, is provided with apertures 20, the upper end plate 3 being closed off from the outside by the provision of a cover 21 which is mounted on the jacket 2. Secured perpendicularly to the collar 11 is an annular plate 18 extending inwardly, i.e. towards the interior of the housing 1.

Figure 4:
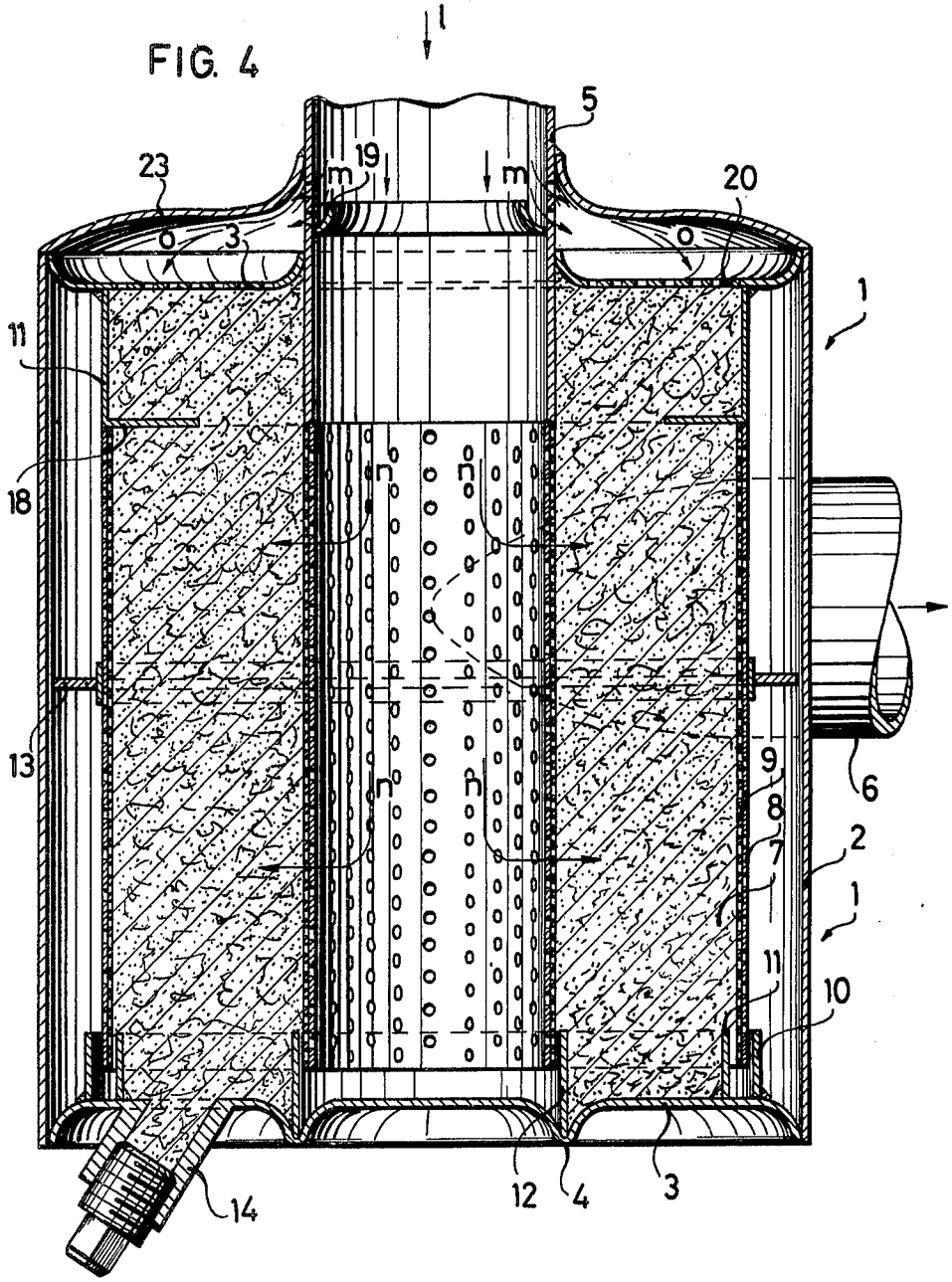
FIG. 4 shows a device having its gas inlet at its upper end together with a gas distributing collar and a perforated end plate.

In the device of FIG. 4, the gas inlet 5, which has an extension running into the interior of the housing 1, is perforated in the region thereof above the upper end plate 3, and the latter is provided with apertures 20. Disposed inside the gas inlet 5, between the above-mentioned perforated region thereof and the level of the upper end plate 3, is a gas distributing collar 19. Mounted between the jacket 2 and the gas inlet 5 is an annular cover 23 which is secured to the gas inlet 5 above the perforated region of the gas inlet 5. Secured perpendicularly to the collar 11 is an annular plate 18 extending inwardly, i.e. towards the interior of the housing 1.

The respective forms of device shown in the drawings function as follows:

FIG. 1: A gas stream a, which is admitted through the gas inlet 5 to the housing 1, is passed through the catalyst for the most part as a radially flowing stream b, but a minor proportion c is deflected by the gas deflecting cone 15 and then flows through the perforated wall of the collar 12. In the region in which the catalyst is accommodated, the gas is finally deflected to form an axial stream d which enables increased pressure (increased in comparison with the pressure exerted by a radial stream) to be exerted against the upper end region of the catalyst bed.

FIG. 2: A gas stream e is admitted through the gas inlet 5 to the housing 1. A minor proportion of it is deflected by the gas distributing collar 19 as shown at f, but a major proportion of the gas is conveyed through the catalyst as a radial stream g. After passing through the perforations provided in the gas inlet 5, the minor proportion of the gas stream f is advanced between the upper end plate 3 and the gas guide plate 22, is redirected, so as to flow axially, within the region between the collars 11 and 12, and then enables the catalyst bed to be compressed.

FIG. 3: A gas stream h is admitted through the gas inlet 5 to the housing 1. A major proportion of the gas is conveyed through the catalyst as a radial stream i, but a minor proportion j, which flows through the apertures 20 provided in the upper end plate 3, is deflected by the cover 21 so as to form an axial stream k permitting pressure to be exerted against the catalyst bed through the apertures 20 in the upper end plate 3.

FIG. 4: A gas stream l is admitted through the gas inlet 5 to the housing 1. A minor proportion of it is deflected by the gas distributing collar 19 into a stream m, although a major proportion of the gas is conveyed through the catalyst as a radial stream n. After passing through the perforations provided in the gas inlet 5, the gas stream m is redirected so forming an axial stream o, which enables pressure to be exerted against the upper end region of the catalyst bed.

I claim:

1. A converter for catalytic conversion of exhaust gas from internal combustion engines comprising: a housing closed by means of an upper and a lower end plate, the lower end plate being penetrated longitudinally by a gas inlet; the housing being provided with a gas outlet opening thereinto rectangularly with respect to the gas inlet and with an inner perforated tube and an outer perforated tube which are spaced apart concentrically with respect to one another so as to form an annular space therebetween; said inner perforated tube being connected to said gas inlet and said outer perforated tube being secured to said lower end plate; said annular space being substantially fully occupied by a granular catalyst forming a bed with an upper free end region; a gas flow-defining means comprising a gas deflecting cone secured to the upper end plate, a first partially perforated metal collar enveloping said deflecting cone being secured substantially perpendicularly to the upper end plate, a second metal collar arranged concentrically to the first metal collar and being secured substantially perpendicularly to the upper end plate, and an annular plate connected substantially perpendicularly to the second metal collar; the gas flow-defining means causing a major proportion of the exhaust gas admitted through the gas inlet to flow radially through said catalyst bed, and a minor proportion thereof to flow axially through said inner tube; said minor exhaust gas proportion being deflected in contact with said cone so as to flow through the perforated portion of the first metal collar and form an axial stream of gas impinging upon the upper free end region of the catalyst bed under a pressure higher than the pressure exerted by the gas flowing radially through the catalyst bed, said higher pressure enabling the catalyst bed to be compressed in longitudinal position.

2. The converter as claimed in claim 1, wherein a third metal collar connected substantially perpendicularly to the upper end plate is arranged between said first and second metal collars; the third metal collar being provided, around its periphery, with aperatures in a region close to the upper end plate.

3. A converter for catalytic conversion of exhaust gas of internal combustion engines comprising: a housing closed by means of an upper and a lower end plate, the upper end plate being penetrated longitudinally by a gas inlet; the housing being provided with a gas outlet opening thereinto rectangularly with respect to the gas inlet and with an inner perforated tube and an outer perforated tube which are spaced apart concentrically with respect to one another so as to form an annular space therebetween; said annular space being substantially fully occupied by a granular catalyst forming a bed with an upper free end region; an inner metal collar, a middle metal collar and an outer metal collar, being secured substantially perpendicularly to the lower end plate; said inner perforated tube being disposed within said inner metal collar and said outer perforated tube being arranged between said middle and said outer metal collar; a gas flow-defining means comprising a first metal collar connected to said gas inlet and enveloping said inner perforated tube, a gas-distributing collar fixed to said first metal collar, a second metal collar secured substantially perpendicularly to said upper end plate, and an annular plate connected substantially perpendicularly to said second metal collar; said first metal collar being provided, around its periphery, with apertures upstream of the gas-distributing collar; the gas flow-defining means causing a major portion of the exhaust gas admitted through the gas inlet to flow first axially through the inner perforated tube and then radially through said catalyst bed, and a minor proportion thereof being deflected in contact with said gas-distributing collar so as to flow through the apertures of said first metal collar and form an axial stream of gas impinging upon the free upper region of the catalyst bed under a pressure higher than the pressure exerted by the gas flowing radially through the catalyst bed, said higher pressure enabling the catalyst bed to be compressed in longitudinal position.

4. The converter as claimed in claim 3, wherein the gas-distributing collar is continued beyond the periphery of the first metal collar so as to form an annular gas guide plate.

5. A converter for catalytic conversion of exhaust gas from internal combustion engines comprising: a housing closed by means of an upper and a lower end plate being penetrated longitudinally by a gas inlet; the housing being provided with a gas outlet opening thereinto rectangularly with respect to the gas inlet and with an inner perforated tube and an outer perforated tube which are spaced apart concentrically with respect to one another so as to form an annular space therebetween; said inner perforated tube being connected to said gas inlet and said outer perforated tube being secured to said lower end plate; said annular space being substantially fully occupied by a granular catalyst forming a bed with an upper free end region; a gas flow-defining means comprising a cover arranged parallel with respect to the upper end plate and being secured to the housing, a plurality of apertures placed in said upper end plate, a first metal collar being secured substantially perpendicularly to the upper end plate, a second metal collar arranged concentrically to the first metal collar and being secured substantially perpendicularly to the upper end plate, and an annular plate connected substantially perpendicularly to the second metal collar; the gas flow-defining means causing a major proportion of the exhaust gas admitted through the gas inlet to flow radially through said catalyst bed, and a minor proportion thereof to flow axially through said inner tube; said minor exhaust gas proportion being deflected inside the cover so as to flow through the apertures in said upper end plate and form an axial stream of gas impinging upon the upper free end region of the catalyst bed under a pressure higher than the pressure exerted by the gas flowing radially through the catalyst bed, said higher pressure enabling the catalyst bed to be compressed in longitudinal position.

6. A converter for catalytic converstion of exhaust gas of internal combustion engines comprising: a housing closed by means of an upper and a lower end plate, the upper end plate being penetrated longitudinally by a gas inlet; the housing being provided with a gas outlet opening thereinto rectangularly with respect to the gas inlet and with an inner perforated tube and an outer perforated tube which are spaced apart concentrically with respect to one another so as to form an annular space therebetween; said annular space being substantially fully occupied by a granular catalyst forming a bed with an upper free end region; an inner metal collar, a middle metal collar and an outer metal collar, being secured substantially perpendicularly to the lower end plate; said inner perforated tube being disposed within said inner metal collar and said outer perforated tube being arranged between said middle and said outer metal collar; a gas flow-defining means comprising an annular cover parallel with respect to the upper end plate and being secured to the housing and to the gas inlet, a plurality of apertures placed in said upper end plate, a gas-distributing collar being disposed inside the gas inlet, said gas inlet being apertured in the region downstream of said annular cover and upstream of said gas-distributing collar, a metal collar arranged concentrically to said gas inlet and being secured substantially perpendicularly to said upper end plate, and an annular plate connected substantially perpendicularly to said metal collar; the gas flow-defining means causing a major proportion of the exhaust gas admitted through the gas inlet to flow first axially through the inner perforated tube and then radially through said catalyst bed, and a minor proportion thereof being deflected in contact with said gas-distributing collar so as to flow through the apertures of said gas inlet which are upstream of said collar and form an axial stream of gas impinging upon the free upper region of the catalyst bed under a pressure higher than the pressure exerted by the gas flowing radially through the catalyst bed, said higher pressure enabling the catalyst bed to be compressed in longitudinal position.

* * * * *